US012139864B2

(12) United States Patent
Rigby et al.

(10) Patent No.: US 12,139,864 B2
(45) Date of Patent: Nov. 12, 2024

(54) VEHICLE MOUNTED SYSTEM FOR DEPLOYING AND RETRIEVING TRAFFIC BARRIERS

(71) Applicant: ARROWES IP HOLDINGS PTY LTD, Red Hill Brisbane (AU)

(72) Inventors: William Patrick Patton Rigby, Red Hill Brisbane (AU); Daniel Tanious, Red Hill Brisbane (AU); McKay Moysey Whight, Red Hill Brisbane (AU); Filippo Capurso, Red Hill Brisbane (AU); Zachary Hugo, Red Hill Brisbane (AU); Chun Zhang, Red Hill Brisbane (AU); Heng La, Red Hill Brisbane (AU)

(73) Assignee: ARROWES IP HOLDINGS PTY LTD, Red Hill (AU)

( * ) Notice: Subject to any disclaimer, the term of this patent is extended or adjusted under 35 U.S.C. 154(b) by 301 days.

(21) Appl. No.: 17/784,344

(22) PCT Filed: Dec. 15, 2020

(86) PCT No.: PCT/AU2020/051369
§ 371 (c)(1),
(2) Date: Jun. 10, 2022

(87) PCT Pub. No.: WO2021/119732
PCT Pub. Date: Jun. 24, 2021

(65) Prior Publication Data

US 2023/0304237 A1 Sep. 28, 2023

(30) Foreign Application Priority Data

Dec. 17, 2019 (AU) ..... 2019904761

(51) Int. Cl.
*E01F 9/70* (2016.01)

(52) U.S. Cl.
CPC ..... *E01F 9/70* (2016.02)

(58) Field of Classification Search
CPC ..... E01F 9/70; B60P 1/5423; B65G 61/00
(Continued)

(56) References Cited

U.S. PATENT DOCUMENTS 5,244,334 A * 9/1993 Akita ..... E01F 9/70 414/501
2009/0097914 A1* 4/2009 Flynn ..... E01F 9/70 404/9
2020/0131725 A1* 4/2020 Hung ..... E01F 9/70

FOREIGN PATENT DOCUMENTS

CN 106555381 A 4/2017
CN 105672162 B 4/2018
(Continued)

OTHER PUBLICATIONS

International Search Report for PCT/AU2020/051369 mailed Feb. 22, 2021 (5 pages).

*Primary Examiner* — James Keenan
(74) *Attorney, Agent, or Firm* — Finnegan, Henderson, Farabow, Garrett & Dunner, LLP

(57) ABSTRACT

A vehicle mountable system for deploying and retrieving traffic barriers to and from a plurality of locations on a road, the system comprising: a gantry frame assembly with one or more horizontal frame members adapted to be positioned on a tray of a vehicle, a first transfer assembly movably coupled with the gantry frame for transferring one or more traffic barriers positioned on the vehicle tray between a storage location on the tray of the vehicle and an intermediate holding location on a platform assembly located below the one or more horizontal frame members of gantry frame assembly, and a second transfer assembly for transfer of the
(Continued)

barriers between the intermediate holding location on the platform and a deployment location on the road.

15 Claims, 16 Drawing Sheets

(58) Field of Classification Search
USPC ..... 414/551
See application file for complete search history.

(56) References Cited

FOREIGN PATENT DOCUMENTS

| | | | |
|---|---|---|---|
| CN | 209099233 | U | 7/2019 |
| CN | 209429001 | U | 9/2019 |
| CN | 110409334 | A | 11/2019 |
| CN | 110775647 | A | 2/2020 |
| GB | 2377244 | A | 1/2003 |
| JP | H08-092921 | A | 4/1996 |

* cited by examiner

VEHICLE MOUNTED SYSTEM FOR DEPLOYING AND RETRIEVING TRAFFIC BARRIERS

This is a national phase application under 25 U.S.C. § 371 of International Application No. PCT/AU2020/051369, filed Dec. 15, 2020, and claims priority from Australian application No. 2019904761, filed Dec. 17, 2019, the entirety of which are herein by reference.

TECHNICAL FIELD

The present invention relates to vehicle mounted system for deploying and retrieving traffic barriers on a road.

BACKGROUND

Any references to methods, apparatus or documents of the prior art are not to be taken as constituting any evidence or admission that they formed, or form part of the common general knowledge.

Building and maintaining urban roads and highways and the high speed highways linking urban areas present a particular problem, primarily due to the speed and density of traffic. Various pieces of equipment and traffic control methods have been used to improve the speed, efficiency and safety of highway work. Such equipment may consist of informative signs posted along roadways, portable flashing warning systems or barriers of various kinds which are provided to direct or control the flow of traffic into specific areas or lanes. The use of traffic barriers particularly cone-shaped markers or traffic barriers (commonly known as traffic cones) during roadworks is well known. These cones may be made from any material but are typically made from extruded polymeric materials.

Usually, traffic barriers such as traffic cones are placed and removed by a number of highway maintenance workers on foot or hanging onto the back of a truck with one hand. The workers involved are exposed to extreme danger because of the speed and density of the traffic. Additionally, the need to rapidly place or remove highway markers or to place such markers over long stretches of highway as on the interstate highway system requires a large number of individual workers which can increase the overall costs for road maintenance projects. Moreover, repeated handling of the traffic cones when deploying and retrieving cones can also lead to manual handling injuries for workers.

In view of the above, there is a need to provide an improved automatic system that can be used for deploying and retrieving traffic barriers in order to address some of the issues with known traffic management practices.

SUMMARY OF INVENTION

In an aspect, the invention provides a vehicle mountable system for deploying and retrieving traffic barriers to and from a plurality of locations on a road, the system comprising:

- a gantry frame assembly with one or more horizontal frame members adapted to be positioned on a tray of a vehicle,
- a first transfer assembly movably coupled with the gantry frame for transferring one or more traffic barriers positioned on the vehicle tray between a storage location on the tray of the vehicle and an intermediate holding location on a platform assembly located below the one or more horizontal frame members of gantry frame assembly,
- a second transfer assembly for transfer of the barriers between the intermediate holding location on the platform and a deployment location on the road.

In an embodiment, the first transfer assembly further comprises a powered hoist for lifting one or more traffic barriers placed on the tray or lowering one or more traffic barriers onto the tray; and a first powered movement mechanism for effecting movement of the hoist along the length of the one or more horizontal frame members.

In an embodiment, the powered hoist comprises:

- a transverse support extending transversely relative to the horizontal member of the gantry frame, the transverse support including a grappling arrangement for grasping one or more of the traffic barriers positioned in the storage location;
- one or more upright rail members extending downwardly from the transverse support and coupled to the transverse support by a coupling arrangement to effect upward and downward movement of the transverse support and the grappling arrangement attached thereto.

In an embodiment, the transverse support and/or the upright rail members are mounted on a motorised carriage adapted for travel along the length of the horizontal members of the gantry assembly.

In an embodiment, the grappling arrangement comprises a plurality of grapplers for simultaneously grasping a corresponding plurality of said traffic barriers for lifting one or more traffic barriers placed on the tray or the platform.

In an embodiment, each grappler comprises a hollow enclosure with guiding surfaces to engage and receive a conical or frustoconical traffic barrier therein and wherein the grappler further comprises a pneumatically actuated engagement for engaging a top portion of the traffic barrier when the barriers are being lifted or lowered by the hoist.

In an embodiment, the platform assembly comprises a conveyor for conveying one or more of traffic barriers positioned on the conveyor between an intermediate holding location and a pre-deployment holding location, wherein the pre-deployment holding location is located in close proximity to the second transfer assembly relative to the intermediate holding location.

In an embodiment of the vehicle mounted system; in a first operable configuration, the conveyor conveys at least one of said barriers positioned on the conveyor from the intermediate holding location to the pre-deployment holding location to allow the second transfer assembly to then transfer the said at least one barrier from the pre-deployment holding location to the deployment location; and in a second operable configuration, the conveyor conveys a barrier positioned on the conveyor from the pre-deployment holding location to an intermediate holding location to allow the second transfer assembly to subsequently transfer another barrier from a deployment location to said pre-deployment location on the conveyor.

In an embodiment, the second transfer assembly comprises:

- one or more gripping members for gripping a barrier member positioned at said intermediate location or the deployment location;
- a powered lifting arrangement coupled to the gripping members to effect upward and downward movement of the gripping members relative to the platform and the road; and a second powered mechanism to effect movement of the gripping members in a lateral direction relative to the direction of motion of the vehicle to allow either deployment of the barriers on the road or retrieval of the barriers from the road.

In an embodiment, the gripping members are mounted on a motorised gripper rail that is adapted for upward and downward movement relative to the platform assembly and the road.

In an embodiment, the gripper rail of the second transfer assembly is movably mounted on a gripper rail mounting assembly for allowing motorised upward and downward movement of the gripper rail relative to the gripper rail mounting assembly.

In an embodiment, the second powered mechanism effects movement the gripper rail mounting assembly in a lateral direction relative to the direction of motion of the vehicle to allow either deployment of the barriers on the road or retrieval of the barriers from the road.

In an embodiment, the gripper rail mounting assembly is fixedly mounted on a movable gripper supporting member that extends transversely relative to the gripper rail, the gripper supporting member being powered for movement in the lateral direction by the second powered mechanism.

In an embodiment, the gripper supporting member is movably mounted relative to a fixed gripper supporting member extending across the length of the tray of the vehicle.

In an embodiment, the vehicle mounted system further comprises a motorised turning mechanism to effect a turning movement of the gripping members relative to a longitudinal axis of the gripper rail through an angle of 180 degrees or more.

In an embodiment, the gripping members comprise a fixed gripping jaw and a movable gripping jaw such that in a closed position, inner surfaces of the jaws cooperate to form a frusto-conical surface for engaging an outer surface of the traffic barrier. In other alternative embodiments, the gripping members may comprise two movable gripping jaws.

In an embodiment, the vehicle mounted system further comprises:

- a sensor assembly for sensing location of a traffic barrier positioned on the road';
- a controller operatively coupled to the sensor assembly and the second powered mechanism to receive location based information from the sensor assembly and in response controlling operation of the second powered mechanism to effect movement of the gripper members towards the traffic barrier positioned on the road.

In an embodiment, the sensor assembly comprises a support structure; a plurality of laser emitters supported by the support structure; a plurality of photodiode detectors supported by the support structure for emitting and detecting multiple pulses in rapid succession by sequentially varying the direction of the emissions such that each distance measurement is a pixel, and a collection of pixels emitted and captured in rapid succession are rendered for detecting the location of the traffic barrier positioned on the road.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows:

FIG. 13A shows the engagement 126 in an open or disengaged condition and FIG. 13B shows the engagement 1256 in an engaging configuration.

FIG. 14A shows the engagement 126 in an open or disengaged condition and FIG. 14B shows the engagement 1256 in an engaging configuration with a top portion of the cone C.

DETAILED DESCRIPTION OF PREFERRED EMBODIMENTS

FIGS. 1 to 12 illustrate a vehicle mounted system 1000 for dispensing and collecting traffic cones (denoted by C) being positioned and attached to a tray (denoted by T) of a motorised vehicle (denoted by V). Whilst, the preferred embodiment illustrates the use of a truck T for mounting the system 100, the system 100 may be mounted on any motorised or non-motorised vehicle such as but not limited to a towable trailer without departing from the spirit and scope of the invention.

Figure 1:
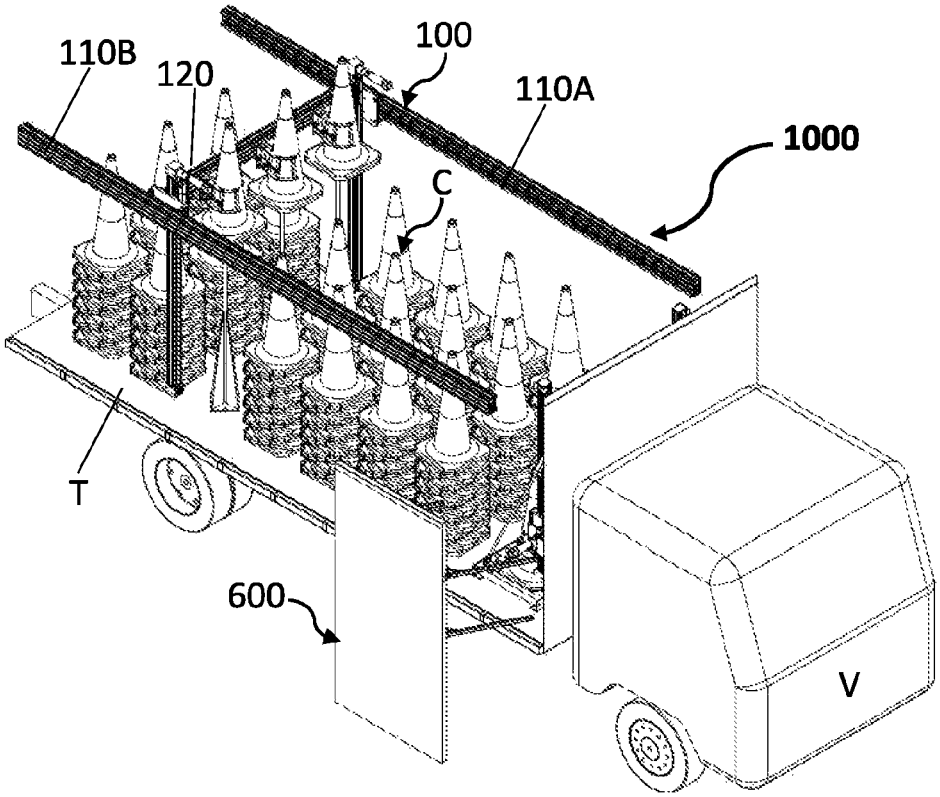
FIG. 1 is a frontal left hand side perspective view a vehicle mounted system 100 for dispensing and collecting cones.
Figure 2:
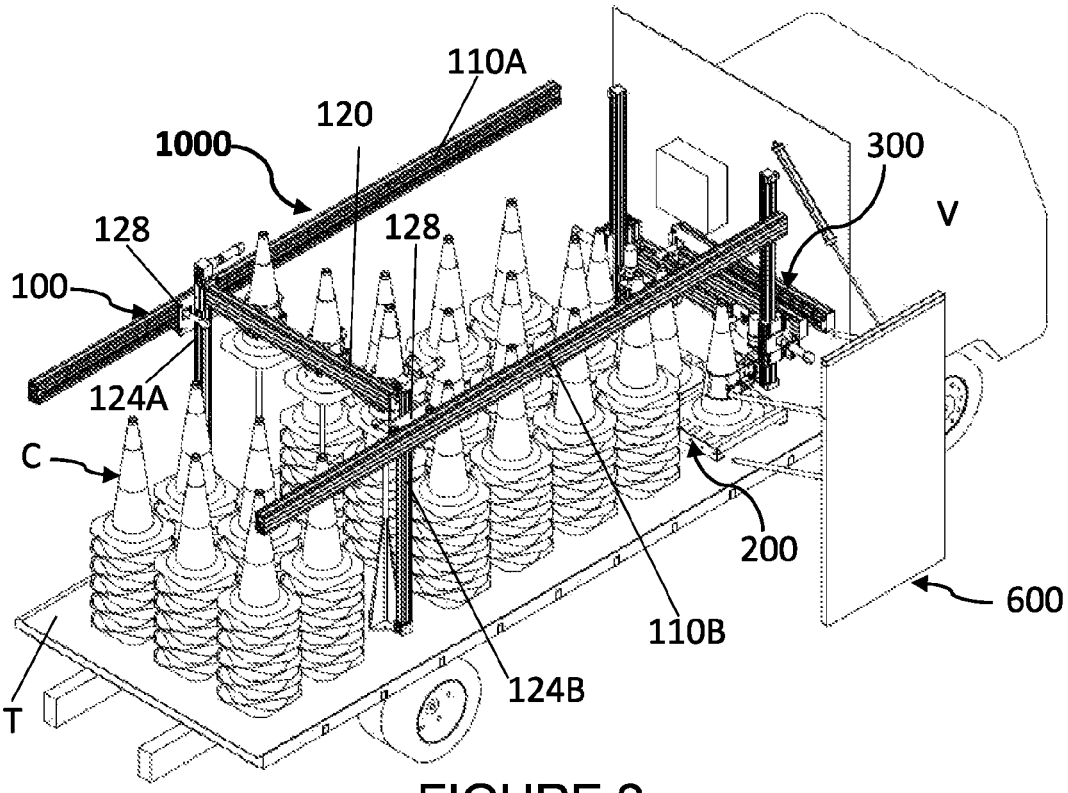
FIG. 2 is another left hand side perspective view of the vehicle mounted system 100 as viewed from a rear end of the vehicle V.
Figure 3:
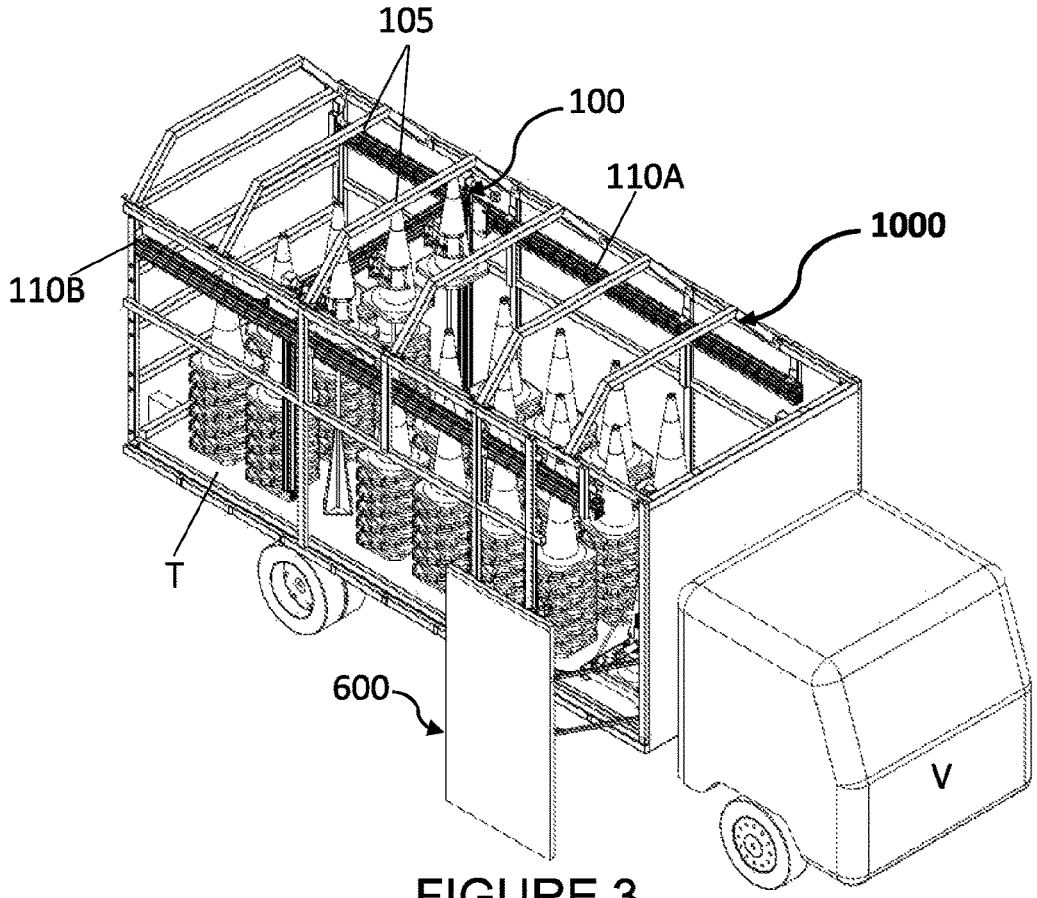
FIG. 3 is a frontal left hand side perspective view the vehicle mounted system 100 with a protective outer frame 105.
Figure 4:
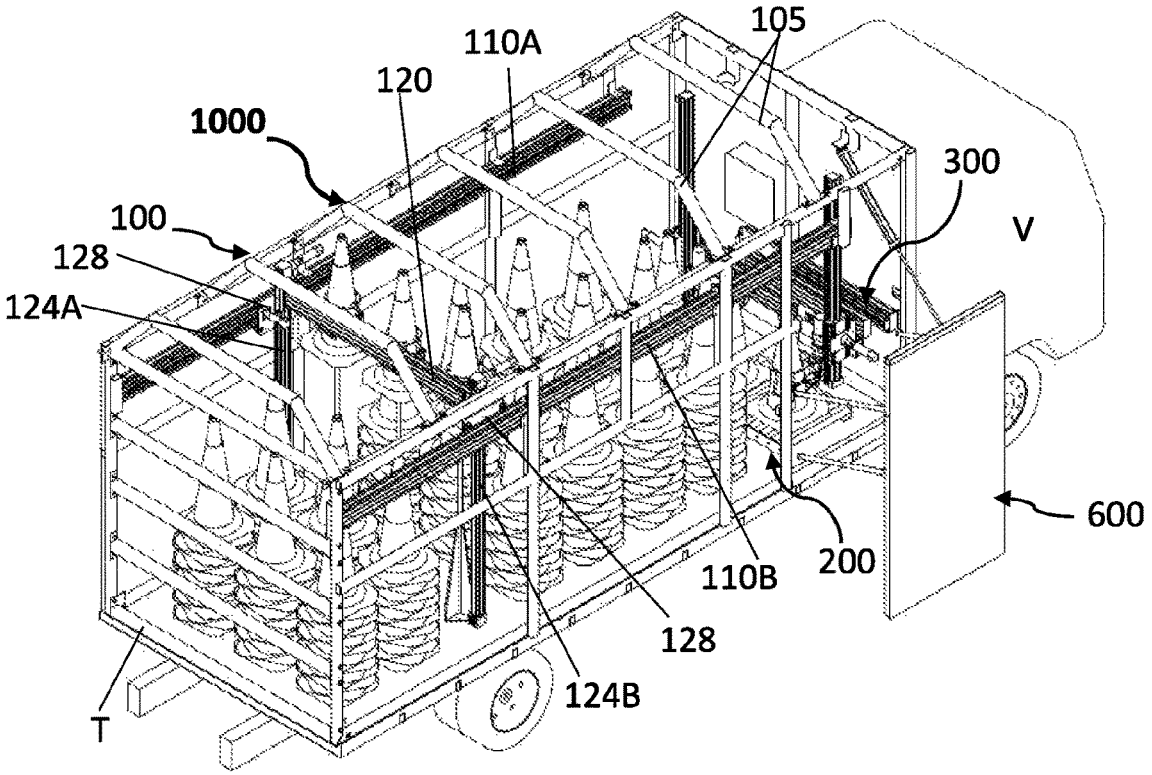
FIG. 4 is a left hand side perspective view of the vehicle mounted system 100 with the protective outer frame 105 as viewed from the rear end of the vehicle V.
Figure 5A:
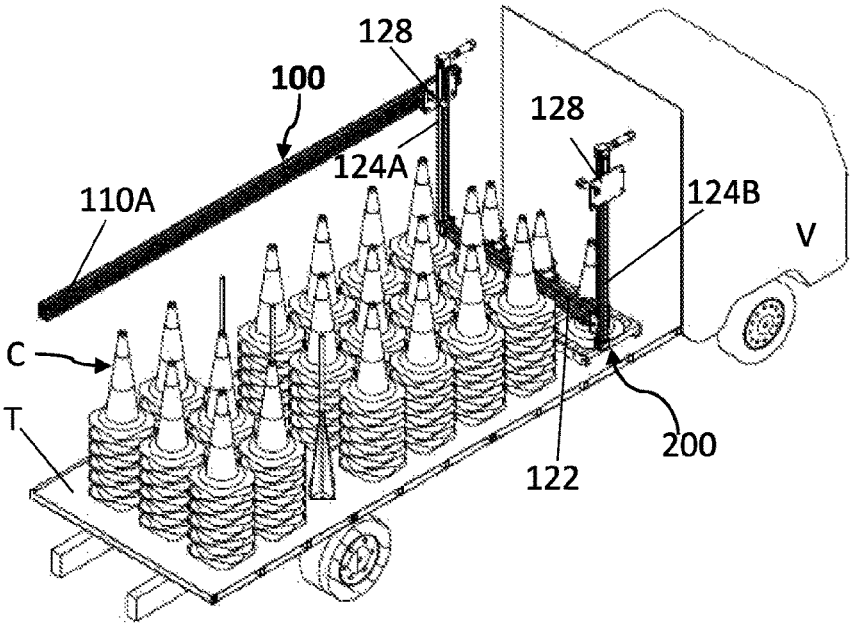
FIGS. 5A to 5C depict perspective, side and top views of the vehicle mounted system 100 in a first stage of transferring traffic cones from an intermediate holding location to a storage location.
Figure 5B:
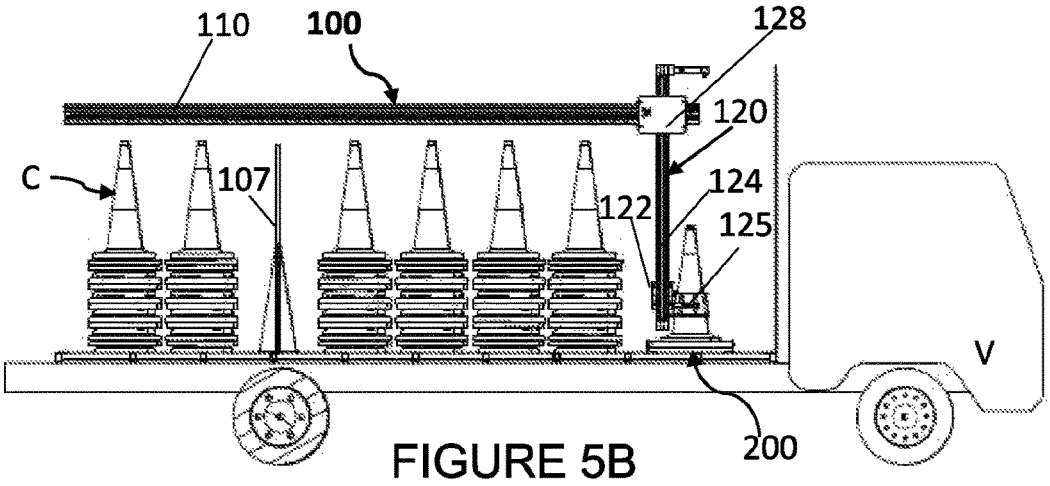
Figure 5C:
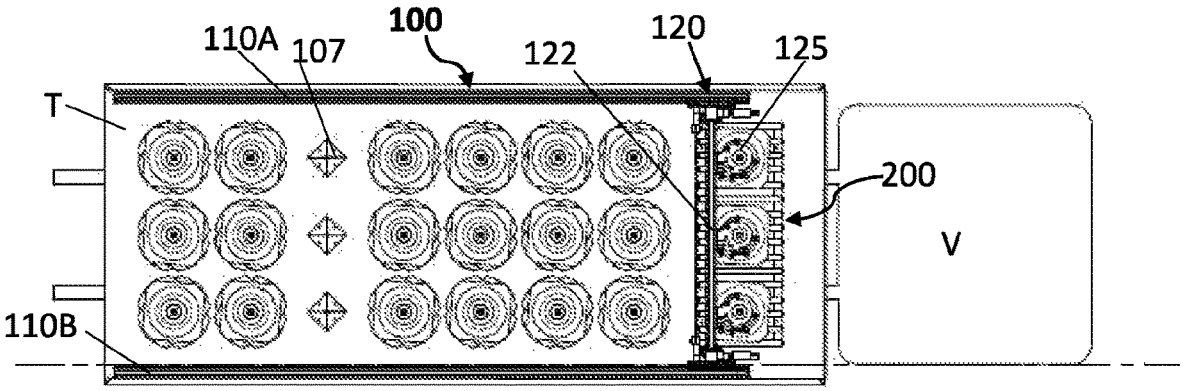
Figure 6A:
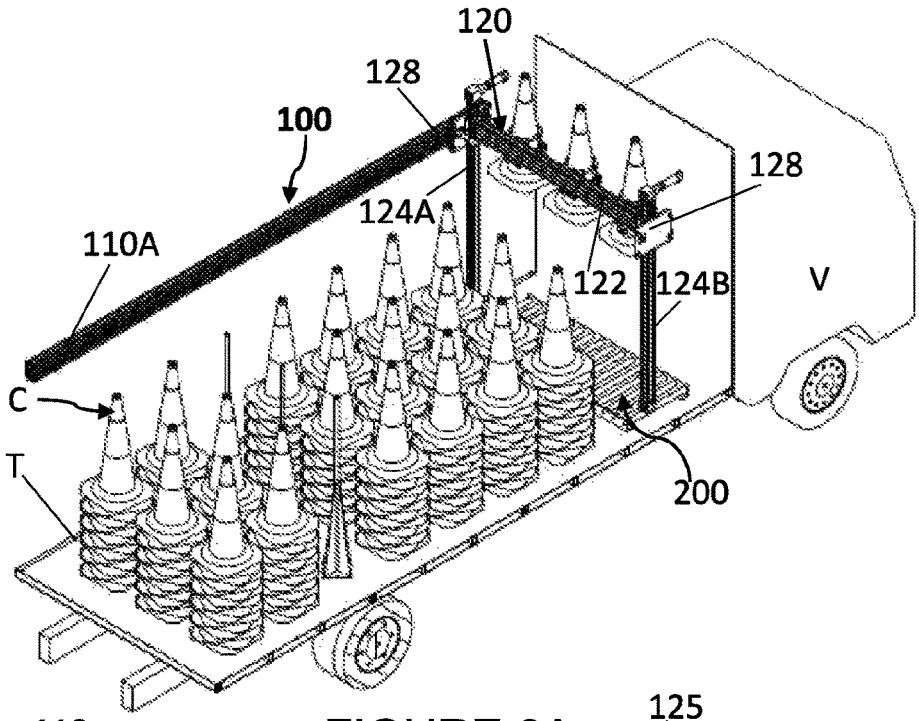
FIGS. 6A to 6C depict perspective, side and top views of the gantry assembly 100 in the vehicle mounted system 100 in a second stage of transferring traffic cones from an intermediate holding location to a storage location.
Figure 6B:
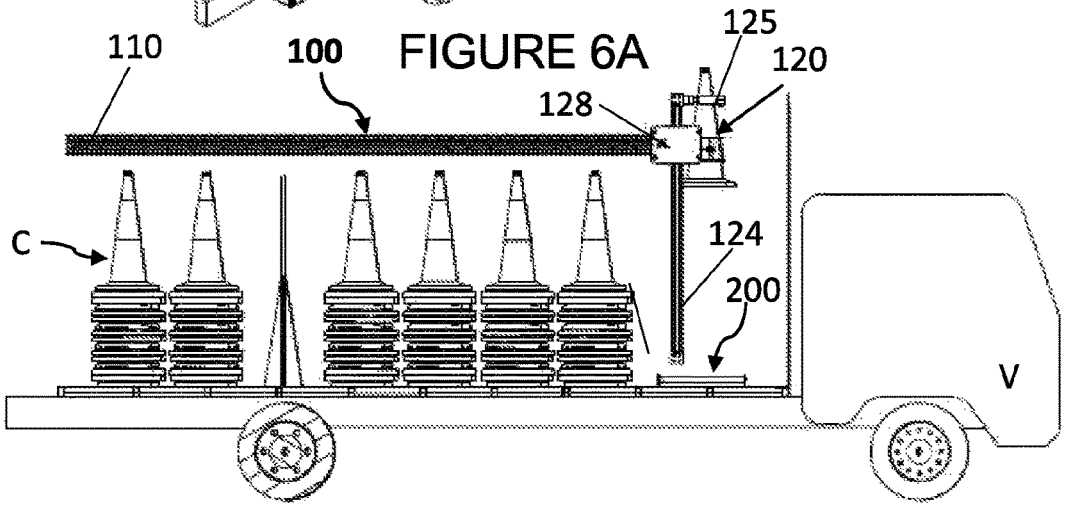
Figure 6C:
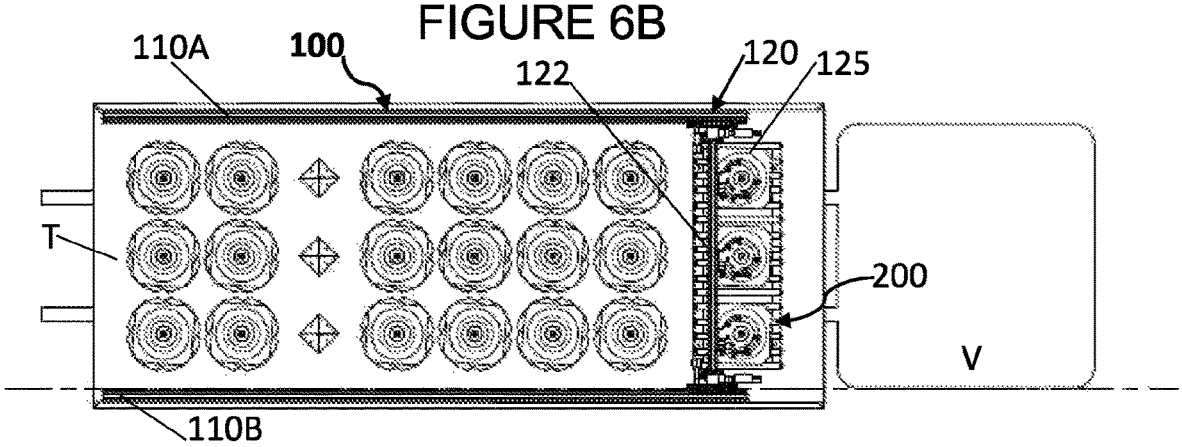
Figure 7A:
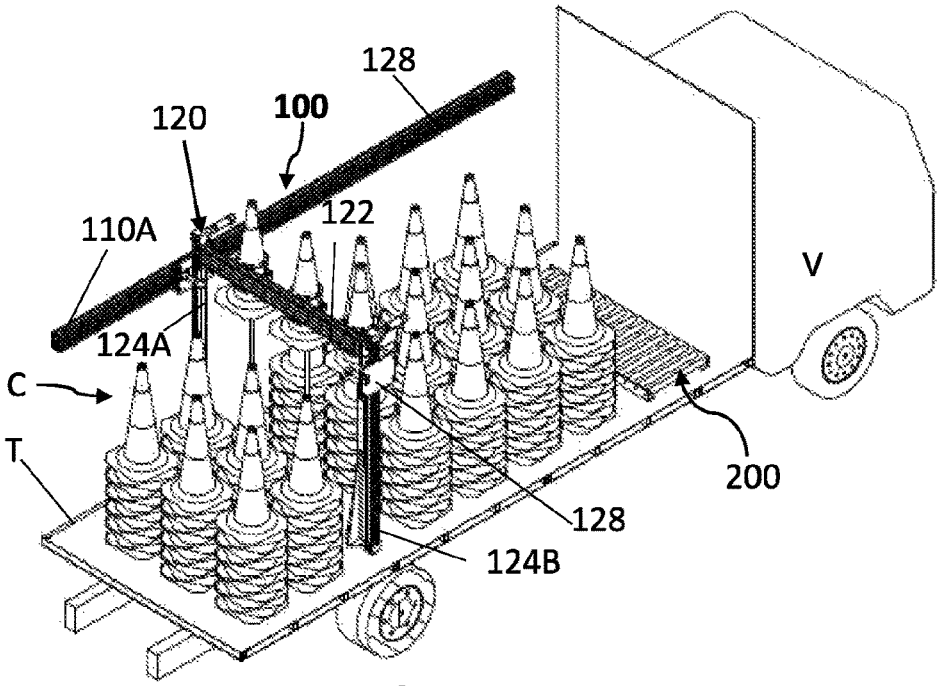
FIGS. 7A to 7C depict perspective, side and top views of the gantry assembly 100 in the vehicle mounted system 100 in a third stage of transferring traffic cones from an intermediate holding location to a storage location.
Figure 7B:
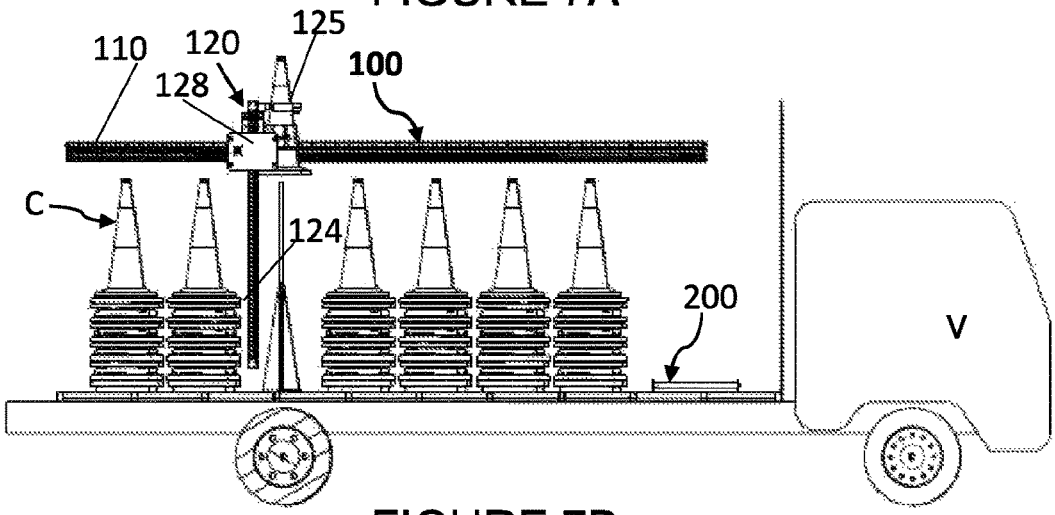
Figure 7C:
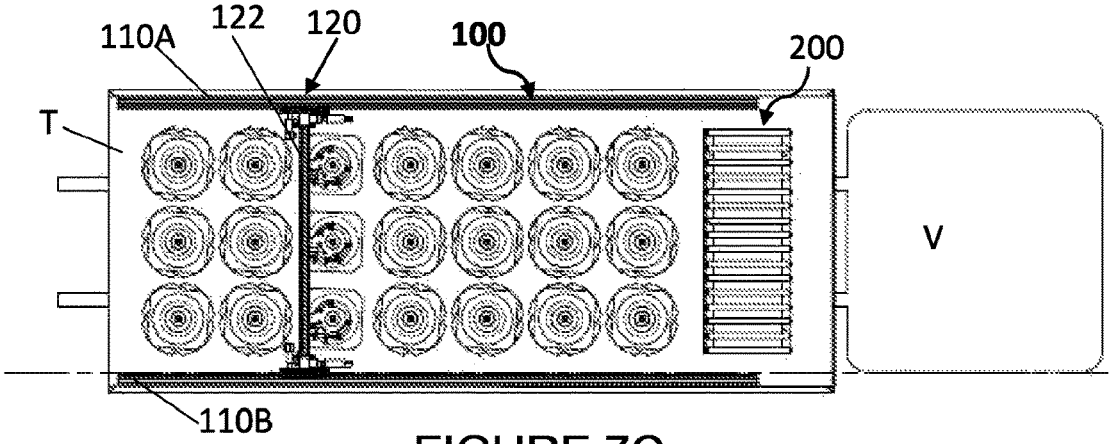
Figure 8A:
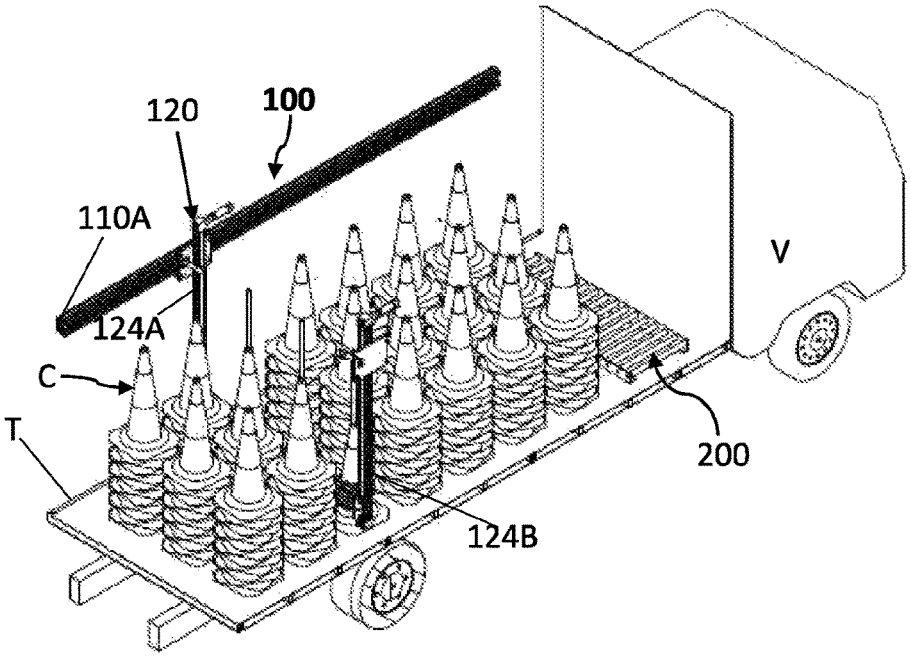
FIGS. 8A to 8C depict perspective, side and top views of the gantry assembly 100 in the vehicle mounted system 100 in a fourth stage of transferring traffic cones from an intermediate holding location to a storage location.
Figure 8B:
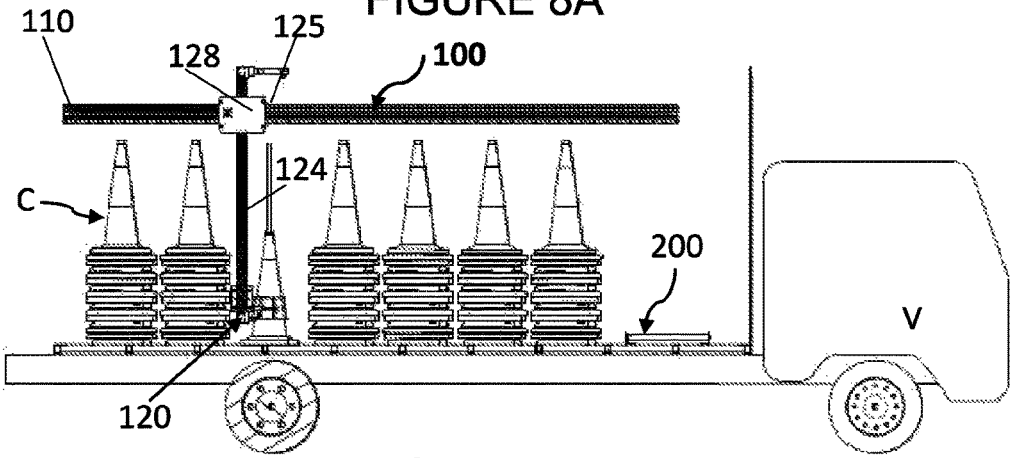
Figure 8C:
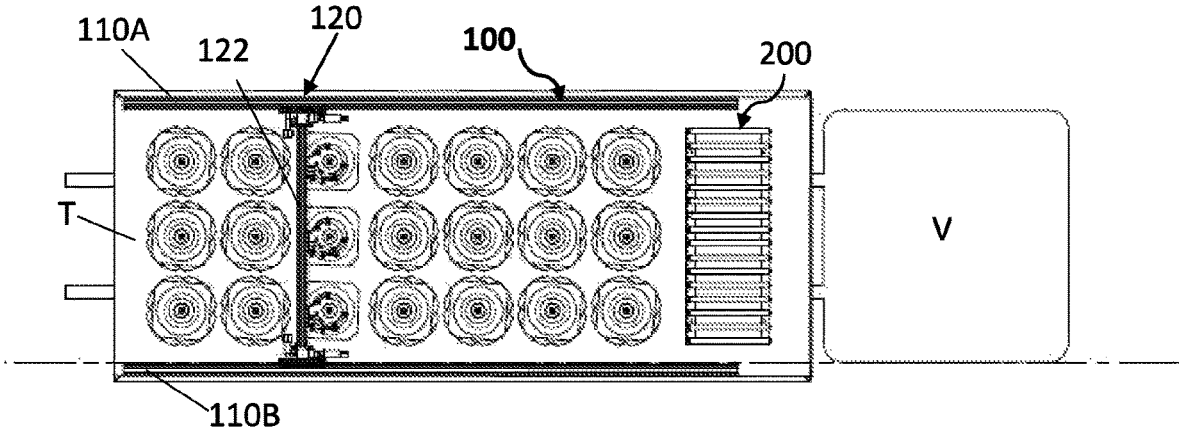

As shown throughout the specification, the system 1000 has been provided for dispensing and collecting a plurality of traffic cones C in a systematic and efficient manner by optimising distribution of traffic cone load on the tray T. One of the advantages of the system 1000, as will be evident from the foregoing sections, is that in a retrieval operation, the system 1000 is able to not only retrieve the cones C but also control the placement of stacked cones C throughout the tray T of the truck V in a systematic manner to evenly distribute weight of the stacked cones placed on the tray T. Similarly, during a deployment operation, the system 1000 is able to collect a plurality cones stacked on the tray from various locations along the tray T in a systematic manner to make sure the weight of the stacked traffic cones C is evenly distributed throughout the tray T during a cone deployment operation. FIGS. 3 and 4 show outer frame members 105 upon which protective panels may be fixed to conceal the contents of the system 1000.

The system 1000 includes a gantry frame assembly 100 with two spaced apart and horizontally oriented overhead gantry frame members 110 extending along the length of the tray T and the chassis of the truck V. The overhead frame members 110A and 110B (denoted generally by 110) are provided to support a powered hoist assembly 120 that can travel along the length of the gantry frame members 110. As can be seen particularly clearly in FIGS. 1 to 4, the movement of the hoist assembly 120 along the length of the overhead gantry frame members 110 allows the hoist assembly 120 to be positioned above any one of the rows of traffic cones C stacked on the tray T at various stacking locations and pick up from or drop traffic cones at specific stacking locations on the tray T. FIGS. 1 to 4 show seven rows of stacked traffic cones with each row having three columns of stacked cones being positioned. The system 100 is in no way limited to any specific arrangement of cones C on the tray of a vehicle and may be suitably adapted for larger or smaller vehicle trays in other embodiments. A powered motor $M_{HG}$ may be used in conjunction with a controller $C_{HG}$ connected to a control board B for driving the hoist assembly 120 along the length of the gantry frame members 110 during a cone retrieval or cone deployment operation. Limit switches $L_G$ may also be installed on the gantry frame members 110 to limit movement of the hoist assembly 120 along one or more specific sections of the frame 110.

The powered hoist assembly 120 includes a transverse support 122 extending transversely relative to the gantry frame members 110. The transverse support 122 that has a grappling arrangement 125 for grasping a plurality of traffic cones from a row of stacked cones placed on the tray T. In the presently described embodiment, each row of stacked cones has three columns of stacked cones C and therefore the grappling arrangement 125 is adapted for grasping three traffic cones (from a specific row of cones) simultaneously during use in a deployment or retrieval operation. It is important to note that the grappling arrangement may grasp one or more cones individually and is no way limited to grasping multiple cones. The hoist assembly 120 also includes a pair of upright rail members 124A and 124B (denoted by 124) that are coupled to the transverse support 122 by a motorised arrangement comprising a motor $M_T$ in conjunction with a controller $C_T$ may be used to effect upward and downward movement of the transverse support 122 and the grappling arrangement 125 attached thereto. Once again, limit switches $L_T$ may be used for limiting the travel of the transverse support 122 along the upright rail members 124A and 124B.

The movement of the transverse support 122 allows the grappling arrangement 125 to be positioned at a plurality of heights and enables the grappling arrangement 125 to engage with a plurality of traffic cones stacked at any specific height in a given row. For example, if in a given row, each column of stacked cones may have 8 cones in a nested or stacked arrangement. The transverse support 122 may be lowered in an operating configuration so that the grappling arrangement 125 engages and grabs three traffic cones from a given row of nested traffic cones thereby leaving 7 cones in each of three columns in the given row of traffic cones. Similarly, in another operable configuration, the transverse support 122 may also be used for placing three traffic cones (or less than three cones) on top of an existing row of cones having the three columns of nested traffic cones positioned on the tray. The tray may also be provided with a plurality of racks 107 (shown in FIG. 5C) for holding nested cones and forming a columns of nested cones for each row of cones positioned on the tray T.

In the presently described embodiment, each upright rail member 124 is mounted on a carriage 128 that can travel along the length of the gantry frame members 110. The movement of the carriage 128 may be effected by a coupling a motor for driving the carriage along the length of the gantry frame members 110. As previously discussed, one or more motors, generally denoted by $M_{HG}$ may be used in conjunction with the controller $C_{HG}$ for controlling the movement of the hoist assembly 120 mounted on the carriage 128 along the length of the gantry frame members 110.

Figure 14A:
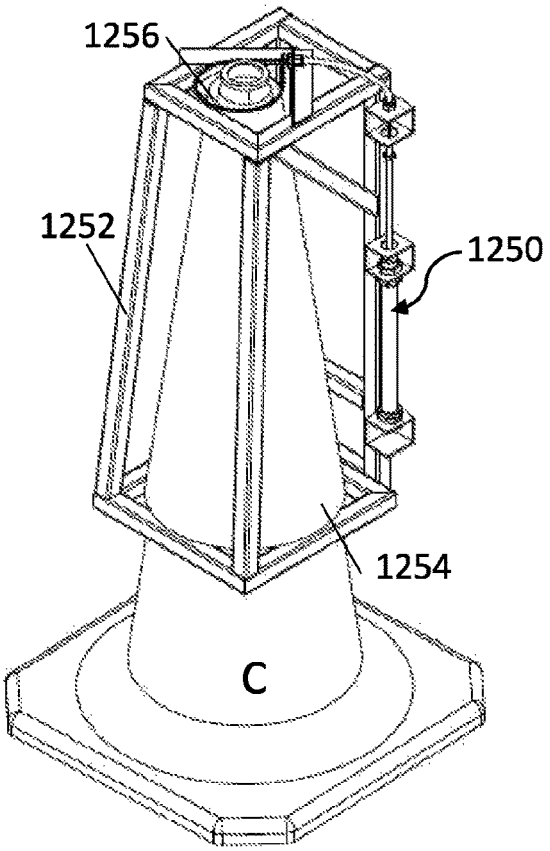
FIGS. 14A and 14B are top perspective views for grappling unit 1250 that forms a part of the grappling arrangement 125 in the gantry assembly 100 with a traffic cone C shown in-situ.
Figure 14B:
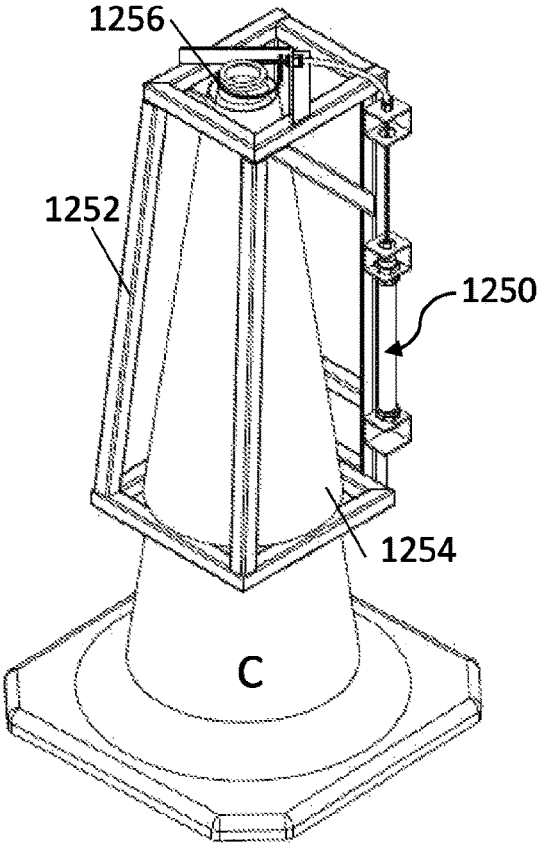

In the preferred embodiment, the grappling arrangement 125 on the transverse member 122 comprises three grapplers 1250 (detailed views shown in FIGS. 13A, 13B and 14A and 14B) for grasping cones while lifting or dropping cones during use. Each grappler 1250 comprises a hollow enclosure defined by an enclosure frame 1252 that may be attached to the transverse support member 122. The enclosure frame 1252 is also provided with guiding surfaces 1254 to guide, engage and receive an outer surface of a conical traffic barrier therein (FIGS. 14A and 14B-cone shown in-situ). The grappler 1250 also comprises a pneumatically actuated engagement 1256 for engaging a top portion of the traffic barrier when the barriers are being lifted or lowered by the hoist. In the preferred embodiment, the pneumatically actuated engagement 1256 comprises an engagement loop member that passes circumferentially around the top portion of the cone received into the enclosure. Upon pneumatic actuation, the engagement loop member is tightened around the apex portion of the cone to become positioned into a circumferential groove CG (shown in FIGS. 14A and 14B) in the apex portion of the cone.

FIGS. 5 to 8 show four stages (steps 1 to 4) during operation of the gantry assembly 110 for transferring three traffic cones from an intermediate location (in which traffic cones are positioned on a platform assembly 200 located at a frontal end of the tray body T) and to a desirable stacking location in a rear portion of the tray T. FIGS. 5A to 5C show an initial step (step 1) in which the hoist assembly 120 is positioned at a frontal end of the tray and subsequently lowered into a lowered configuration for picking up three traffic cones placed on the platform 200 (at an intermediate holding location) by actuating the pneumatic engagement 126. In a second step shown in FIGS. 6A to 6C, the hoist assembly 120 is raised by the upward movement of the transverse member 122 (step 2) along the upright rail members 124 to position the carriage 128 along the gantry rails 110. In a third step, shown in FIGS. 7A to 7C, the carriage 128 for the hoist assembly 120 is actuated to move the hoist assembly 120 along the length of the gantry frame members 110 towards a rear end of the gantry frame members 110. Once the hoist assembly 120 has undergone horizontal movement to reach a designated location, the hoist assembly 120 may once again be lowered and the cones held by the grappling arrangement 125 may be released from the pneumatic engagement mechanism 126 thereby completing a transfer of three cones from an intermediate holding location in the front of the tray to a nesting or stacking location in a rear portion of the tray T.

One of the important advantages afforded by the gantry assembly 100 of the presently described embodiment is that the placement of the traffic cones can be effectively managed to evenly distribute the weight of the nested traffic cones placed on the tray. By way of example, the gantry assembly 100 may progressively pick up three cones at a time (using the grappling arrangement 125) from a row having three columns of nested or stacked cones by starting at a first row of cones (at the rear end of the tray t) and then progressing forward in a row by row fashion to ensure that weight of the nested cones remains evenly distributed. Similarly, during a retrieval process, the traffic cones may be stacked in a sequential manner to ensure that weight is evenly spread over the tray T. The use of the gantry 100 also optimises the use of storage space on the tray T.

Referring to FIGS. 9 to 12, the platform assembly includes a motorised conveyor 200 driven by a motor $M_{200}$ working in conjunction with a controller $C_{200}$. The conveyor 200 is adapted to convey the cone traffic cones from either left to right or from right to left (relative to the length of the tray T) thereby allowing the traffic cones to be positioned at multiple intermediate holding locations during a cone deployment or retrieval operation, as will be evident from the foregoing sections. Limit switches $L_{200}$ may be used for limiting the movement of the conveyor 200. In FIGS. 5A, 6A, 7A and 8A one of the gantry rails 110 has not been shown for illustrative purposes only.

FIGS. 9 to 12 show four stages (steps 1 to 4) during operation of the conveyor 200 in combination with a second transfer assembly 300 for transferring three traffic cones from an intermediate location (in which traffic cones are positioned on a platform assembly 200 located at a frontal end of the tray body T) and to a desirable deployment location on the road (on either lateral side of the tray T) by utilising a second transfer assembly 300. The four stages of deployment of cones will be explained in further detail in the foregoing sections.

Figure 15A:
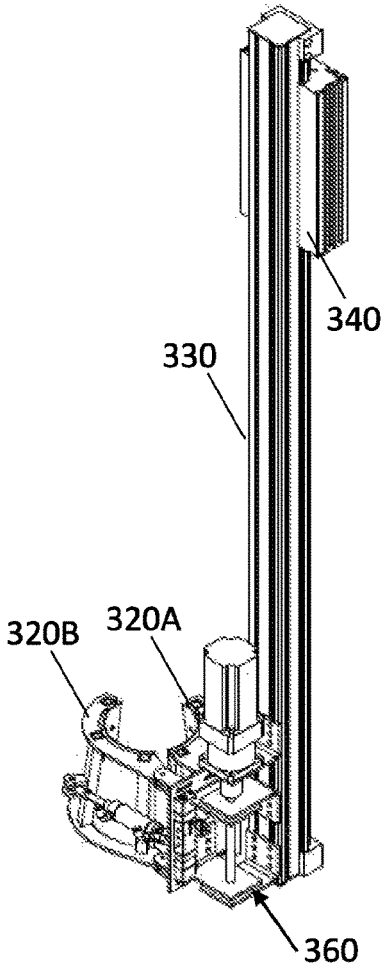
FIGS. 15A to 15C are isolated views for the gripping arrangement 320 and the gripper rail 330 that form part of the second transfer assembly 300 in the vehicle mounted system 1000 in which the gripping jaws 320 are shown to turn through an angle of 180 degrees.
Figure 15B:
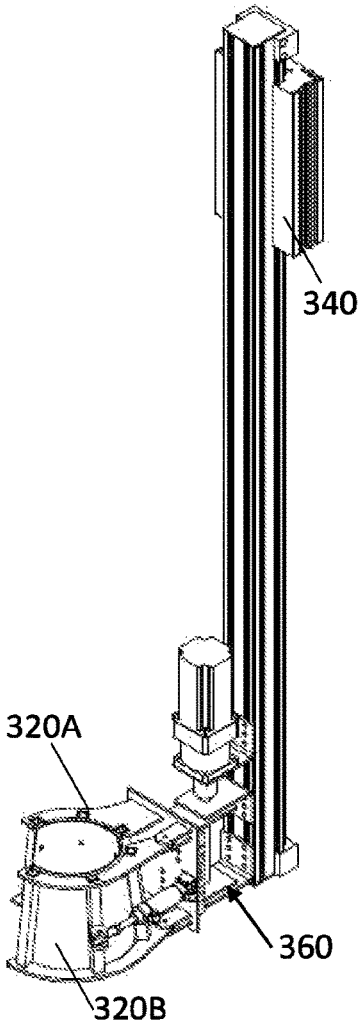
Figure 15C:
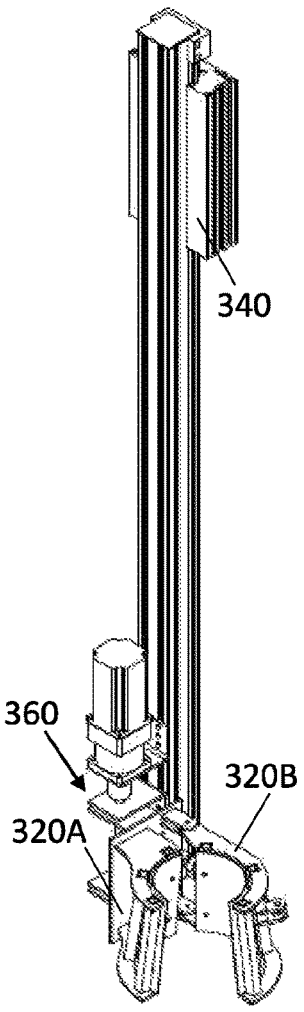
Figure 16A:
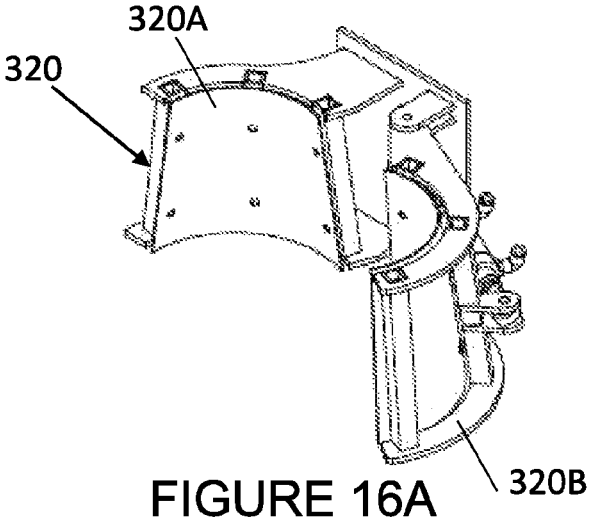
FIGS. 16A to 16C are isolated views for the gripping arrangement 320 that form part of the second transfer assembly 300 in the vehicle mounted system 1000.
Figure 16B:
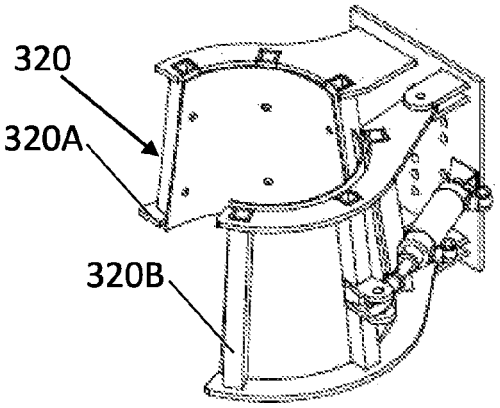
Figure 16C:
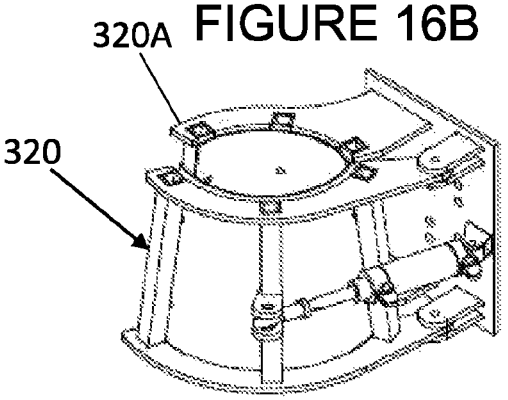

The second transfer assembly 300 includes a pair of gripping members, specifically a fixed jaw 320A and a movable jaw 320B (best shown in FIGS. 15 and 16). Each of these jaws 320 include curved inner surfaces 321 for engaging an outer surface of the traffic cones. During use, the movable jaw may be pneumatically actuated to close the movable jaw 320B with the fixed jaw 320A such that the jaws 320 cooperate to form a frusto-conical inner surface for engaging an outer surface of the traffic cone. The shape of the jaws 320 are not limiting and gripping members with other structural configurations may be used for gripping traffic cones without departing from the spirit and scope of the invention.

The second transfer assembly 300 also includes a powered lifting arrangement to effect upward and downward movement of the gripping members 320 relative to the platform assembly 200 and the road. In the presently described embodiment, the gripping jaws 320 are mounted to an upright gripper rail 330, the gripper rail 330 being adapted for upward and downward movement relative to transverse gripper supporting rail 352 by way of being mounted on a mounting assembly 340 (that attaches to the transverse gripper supporting rail 352). As shown in FIGS. 15A to 15C, the mounting assembly 340 includes bracket that is fixedly attached to the transverse gripper supporting rail 352 and has a channel to allow the upright gripper rail 330 to pass through and travel up and down relative to the mounting assembly 340 and the transverse gripper supporting rail 352. A motorised arrangement comprising a motor $M_{330}$ may be provided to drive the gripper rail 330 in the desired upward and downward direction by using an associated controller $C_{300}$. One or more limit switches $L_{330}$ may be used to limit the upward and downward movement of the gripper rail 330.

An additional second powered mechanism (not shown) is also provided to effect movement of the gripping jaws 320 and the attached gripper rail 330 in a lateral direction relative to the direction of motion of the vehicle V to allow either deployment of the traffic cones on the road or retrieval of the cones from the road. The powered mechanism (not shown) comprising a motor $M_{350}$ controlled by a controller $C_{350}$ allows the gripper supporting rail 352 to extend outwards towards a lateral side of the tray T. In the present embodiment, the movable gripper supporting rail 352 is mounted on a movable carriage 353 that travels along a fixed gripper supporting rail 354 that also extends transversely relative to the upright gripper rail 330. Once again, limit switches $L_{350}$ may be used for controlling the extent of lateral movement.

Figure 9A:
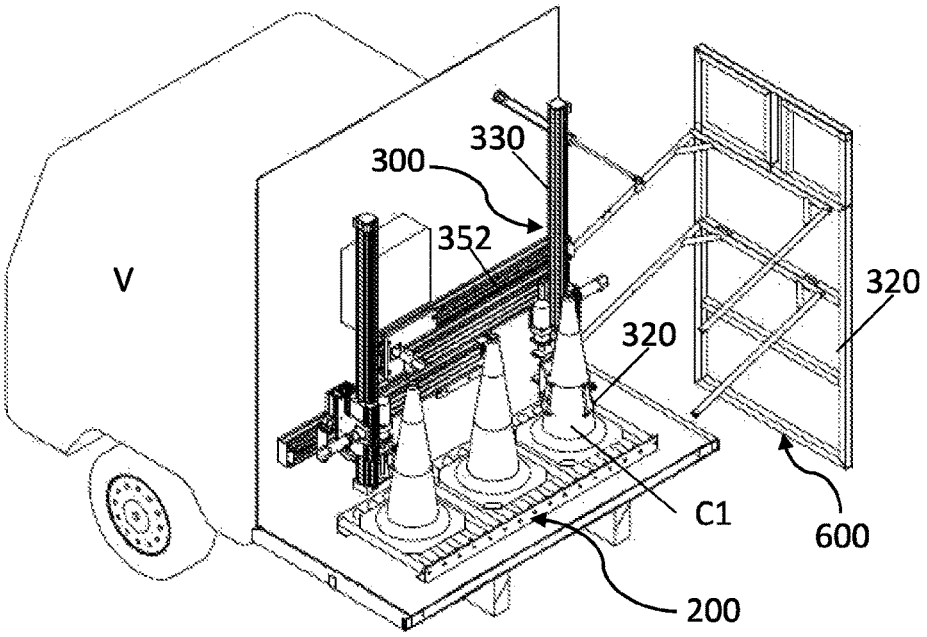
FIGS. 9A to 9C depict perspective, side and top views of the second transfer assembly 300 in the vehicle mounted system 100 in a first stage of transferring traffic cones from an intermediate holding location to a deployment location.
Figure 9B:
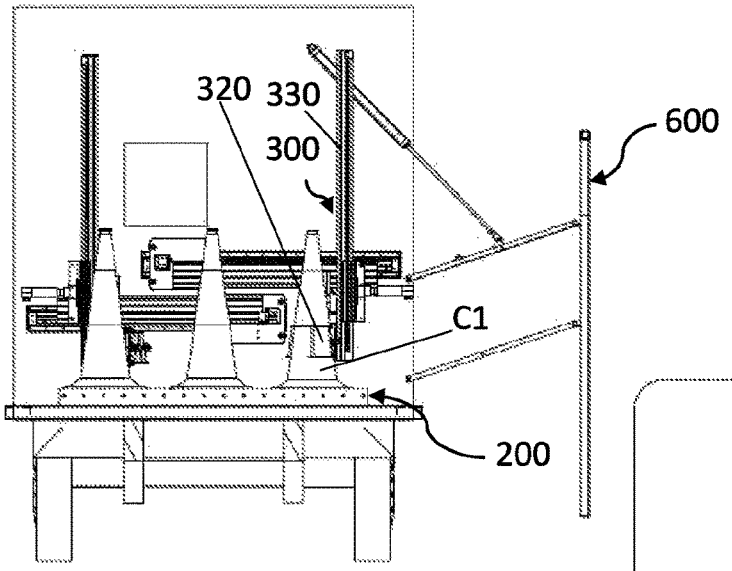
Figure 9C:
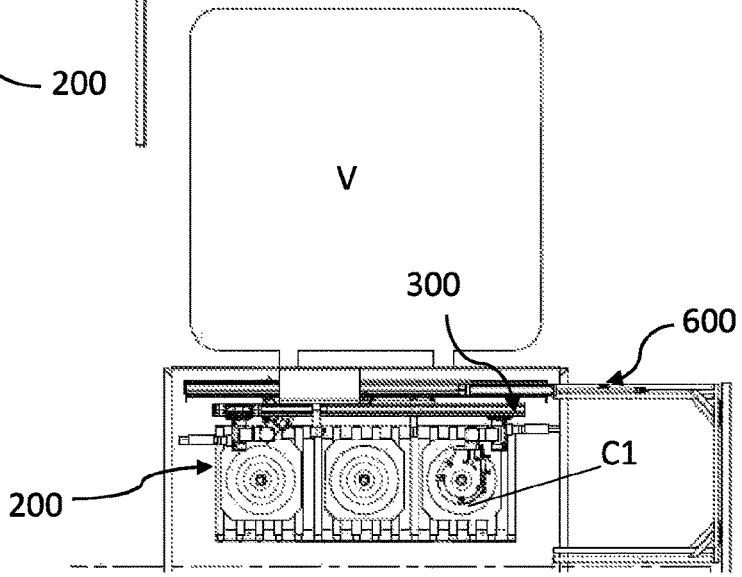
Figure 10A:
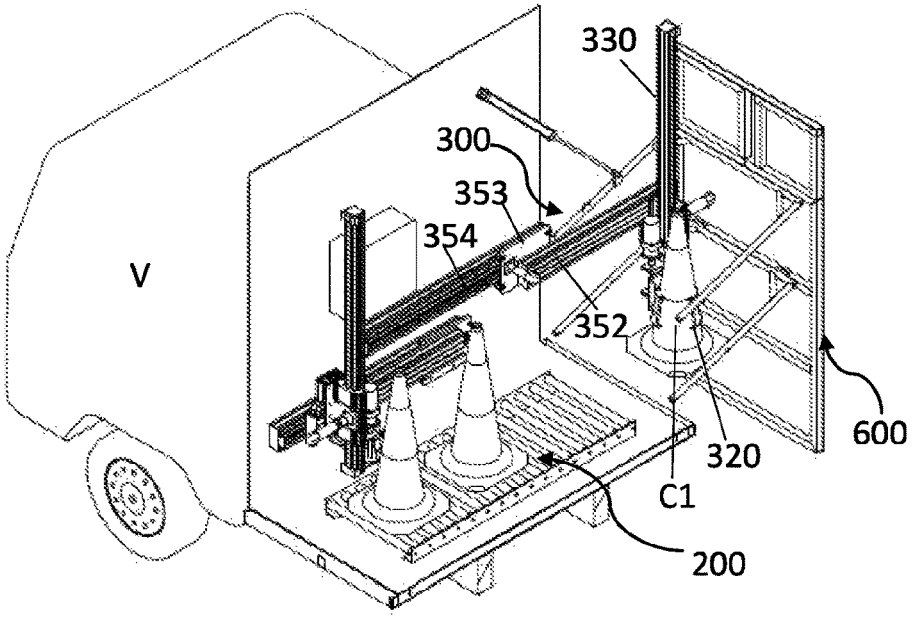
FIGS. 10A to 10C depict perspective, side and top views of the second transfer assembly 300 in the vehicle mounted system 100 in a second stage of transferring traffic cones from an intermediate holding location to a deployment location.
Figure 10B:
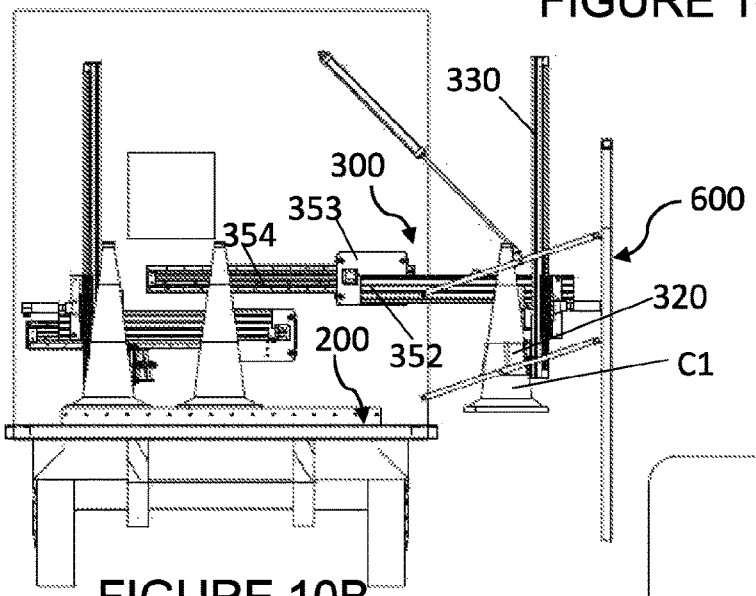
Figure 10C:
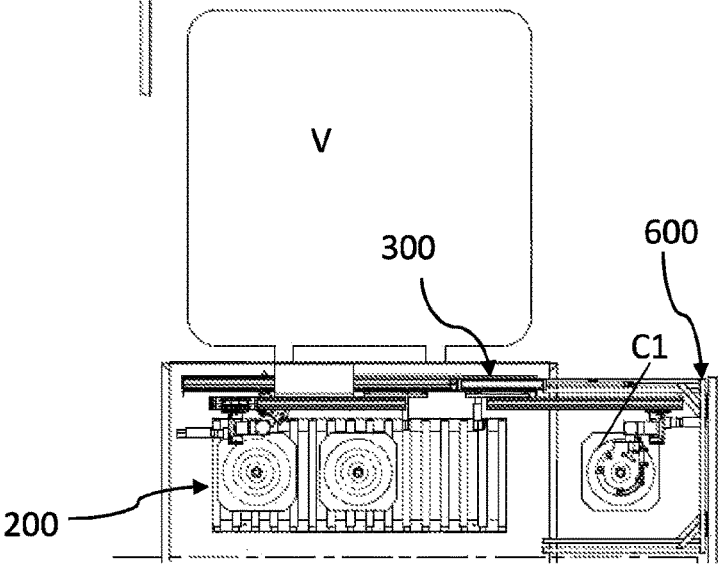
Figure 11A:
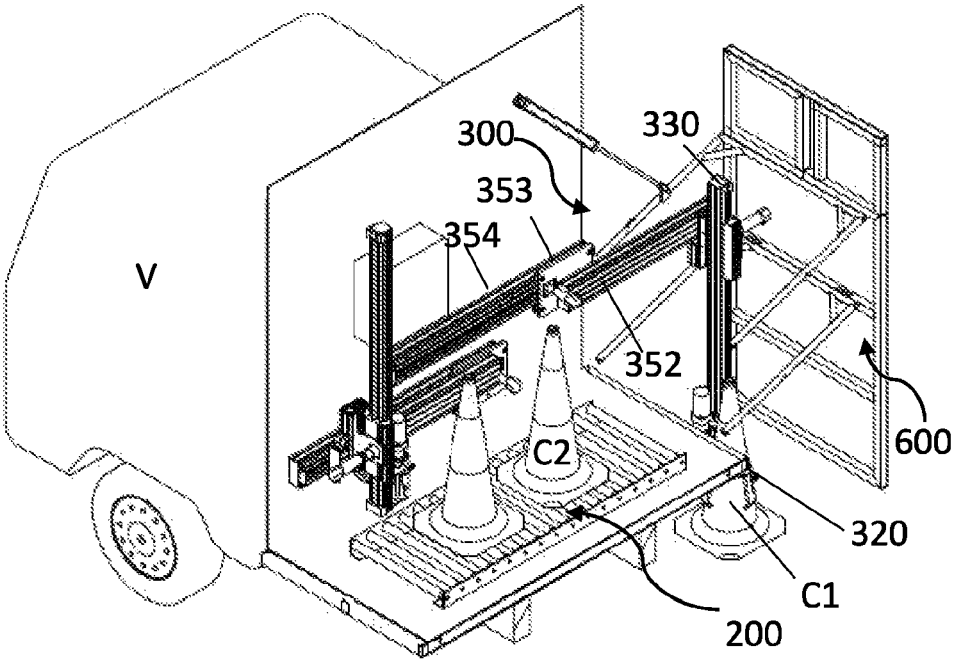
FIGS. 11A to 11C depict perspective, side and top views of the second transfer assembly 300 in the vehicle mounted system 100 in third stage of transferring traffic cones from an intermediate holding location to a deployment location.
Figure 11B:
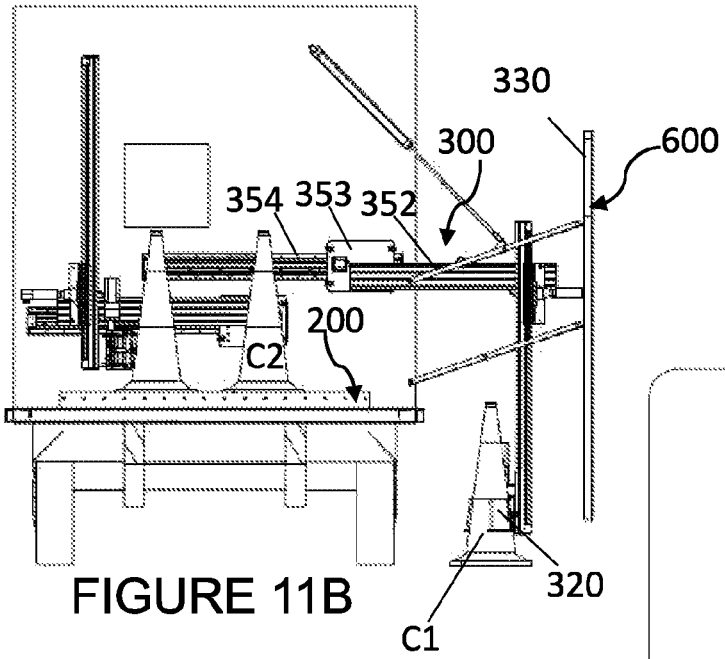
Figure 11C:
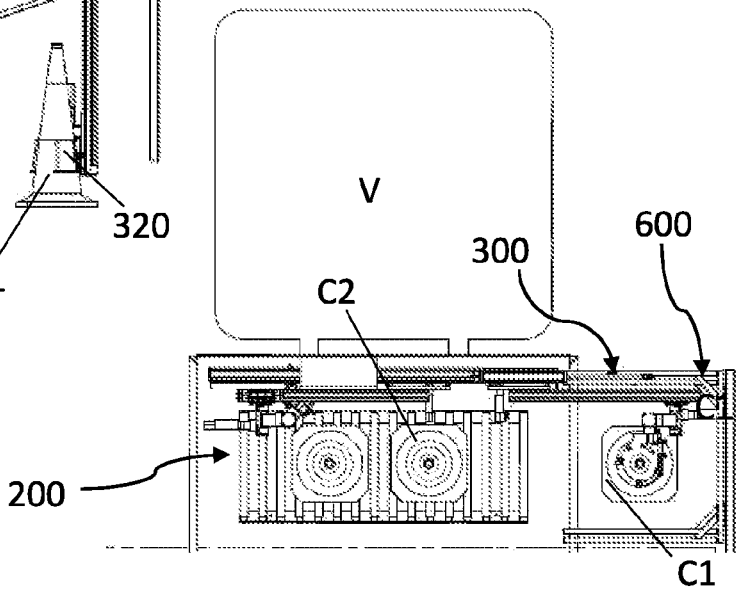
Figure 12A:
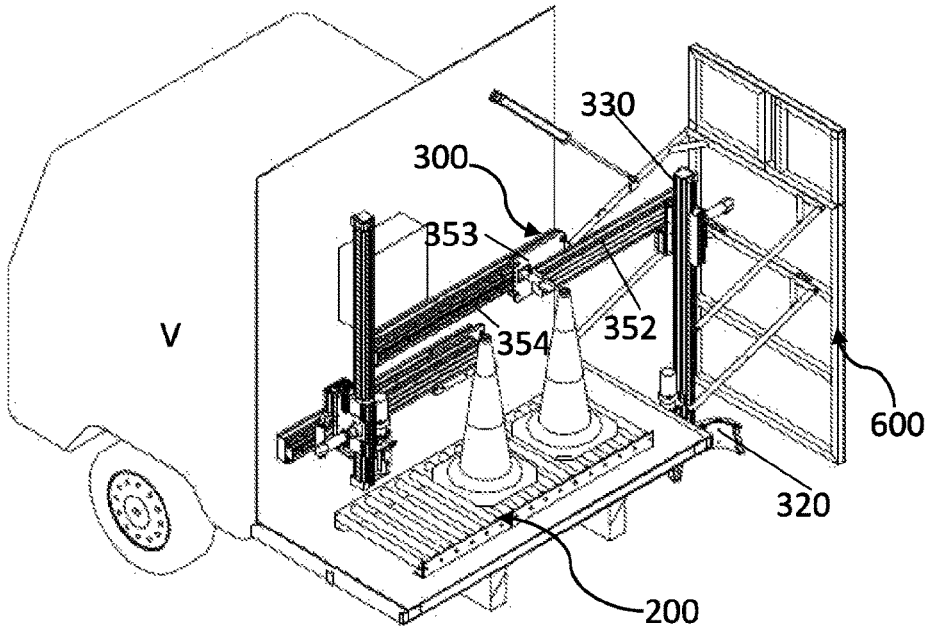
FIGS. 12A to 12C depict perspective, side and top views of the second transfer assembly 300 in the vehicle mounted system 100 in a fourth stage of transferring traffic cones from an intermediate holding location to a deployment location.
Figure 12B:
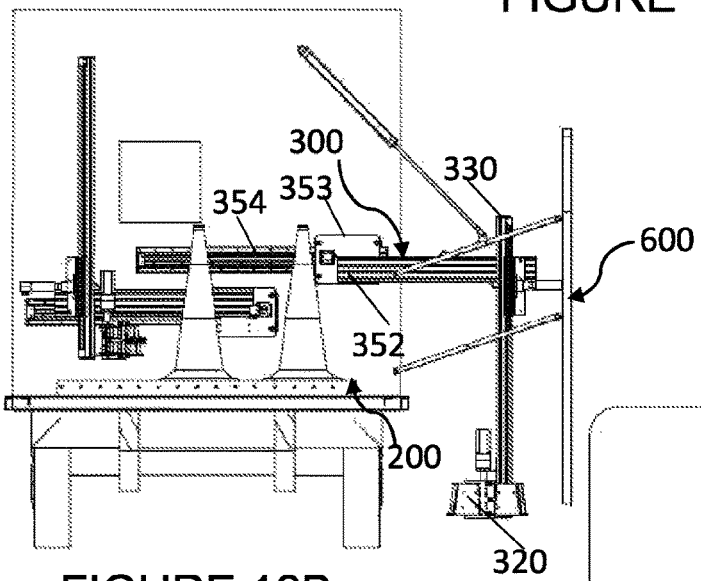
Figure 12C:
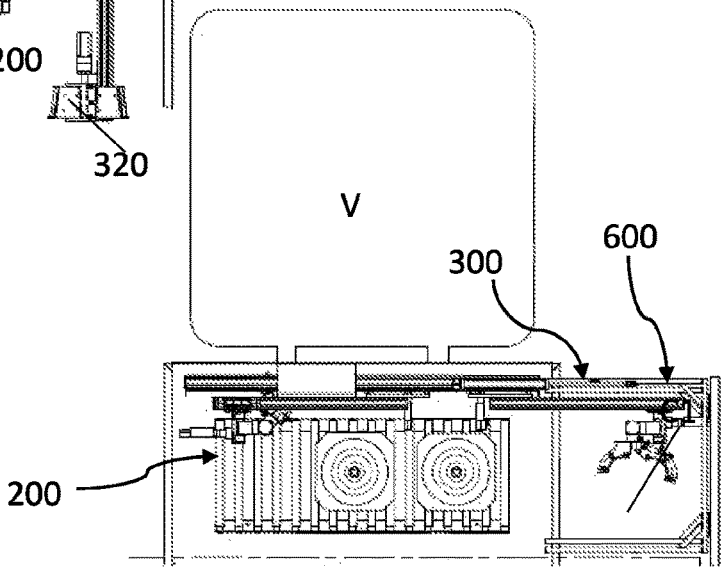
Figure 13A:
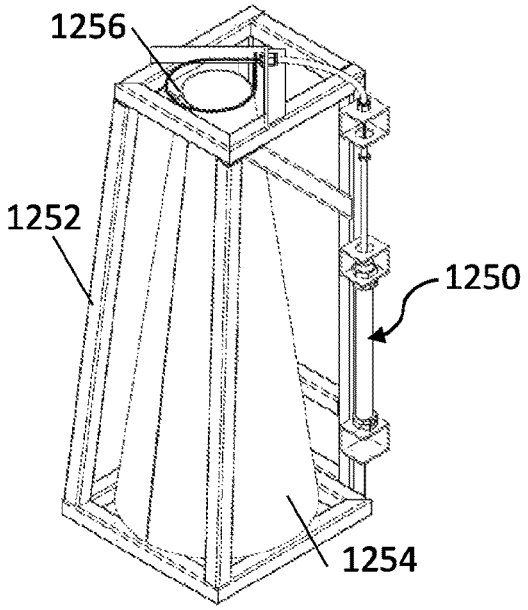
FIGS. 13A and 13B are top perspective views for grappling unit 1250 that forms a part of the grappling arrangement 125 in the gantry assembly 100.
Figure 13B:
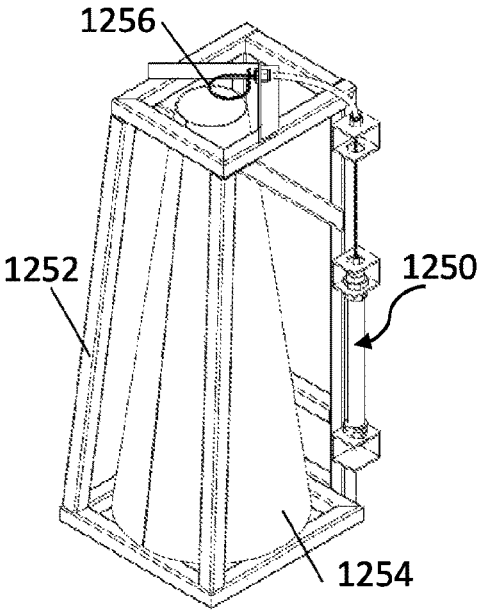

FIGS. 9A to 9C show an initial step in the movable gripper mounting assembly 340 is positioned at a suitable vertical height along the gripper rail 330 in order to engage a traffic cone $C_1$ that is positioned on the conveyor 200 at a pre-deployment location. The movable gripping jaw 320B is actuated to engage and grip the traffic cone in between the jaws 320. Once the traffic cone $C_1$ has been firmly gripped by the gripping jaws 320, the gripper mounting assembly 340 is moved in a slightly upward direction into an intermediate raised configuration to ensure that the base of the cone $C_1$ is no longer in contact with the conveyor 200. Referring to FIGS. 10A to 10C (in a second step), once the position of the gripper mounting assembly 340 has been temporarily fixed in the intermediate raised configuration, the movable gripper supporting rail 352 is extended in an outwardly direction towards a lateral side of the tray T. Specifically, the movable carriage 353 may be motorised to effect the movement of the movable gripper supporting rail 352 relative to the fixed supporting rail 354. The outward and lateral movement of the movable gripper supporting rail 352 results in the cone $C_1$ (which is being gripped by the gripping jaws 320) being positioned directly above the deployment location on the road.

In a third step (shown in FIGS. 11A to 11C), the gripper mounting assembly 340 and the gripper rail 330 are lowered to position the base of the cone $C_1$ at the deployment location on the road. Once the cone $C_1$ has been positioned on the road, the cone $C_1$ may be released from the jaws 320 by electronically actuating the jaws 320 to be toggled from a closed position to an open position. In the meantime, the conveyor 200 may also be activated to convey another cone $C_2$ from an intermediate holding location on the conveyor 200 to the pre-deployment location on the conveyor 200 to position the second cone $C_2$ for deployment at another deployment location along the road. It would be understood, that once an initial cone, say $C_1$, has been deployed on the road, the vehicle V and the trailer T typically undergoes travel in a forward or reverse direction in order to position another cone, say $C_2$ in a subsequent deployment location. In this regard, the gripper rail 330 may be moved in an upward direction to ensure that the cone $C_1$ is not knocked down by the gripper rail 330 whilst the vehicle V is undergoing travel in the forward or reverse direction. In some further embodiments, a motorised turning mechanism 360 may also be provided effect a turning movement of the gripping jaws 320 relative to a longitudinal axis of the gripper rail through an angle of 180 degrees to further avoid contact with a deployed cone and the gripping jaws 320 while the vehicle is travelling in the forward to reverse direction.

An outwardly extendable door assembly 600 is provided to work in tandem with the second transfer assembly 300. The outward extension of the door assembly 600 provides sufficient room for the gripper supporting movable rail 352 to extend outwardly and allowing the gripper rail 330 to move upwardly or downwardly for retrieval or deployment of traffic cones from the road. The retractable configuration of the second transfer assembly 300 in combination with the door assembly 600 and the conveyor platform assembly 200 allows the system to be relatively compact thereby allowing the vehicle mounted system to have a streamlined configuration during period of non-use. The retrieval of deployed cones may also be carried out by the second transfer assembly 300 by undertaking the four steps of deployment in reverse order.

Figure 17:
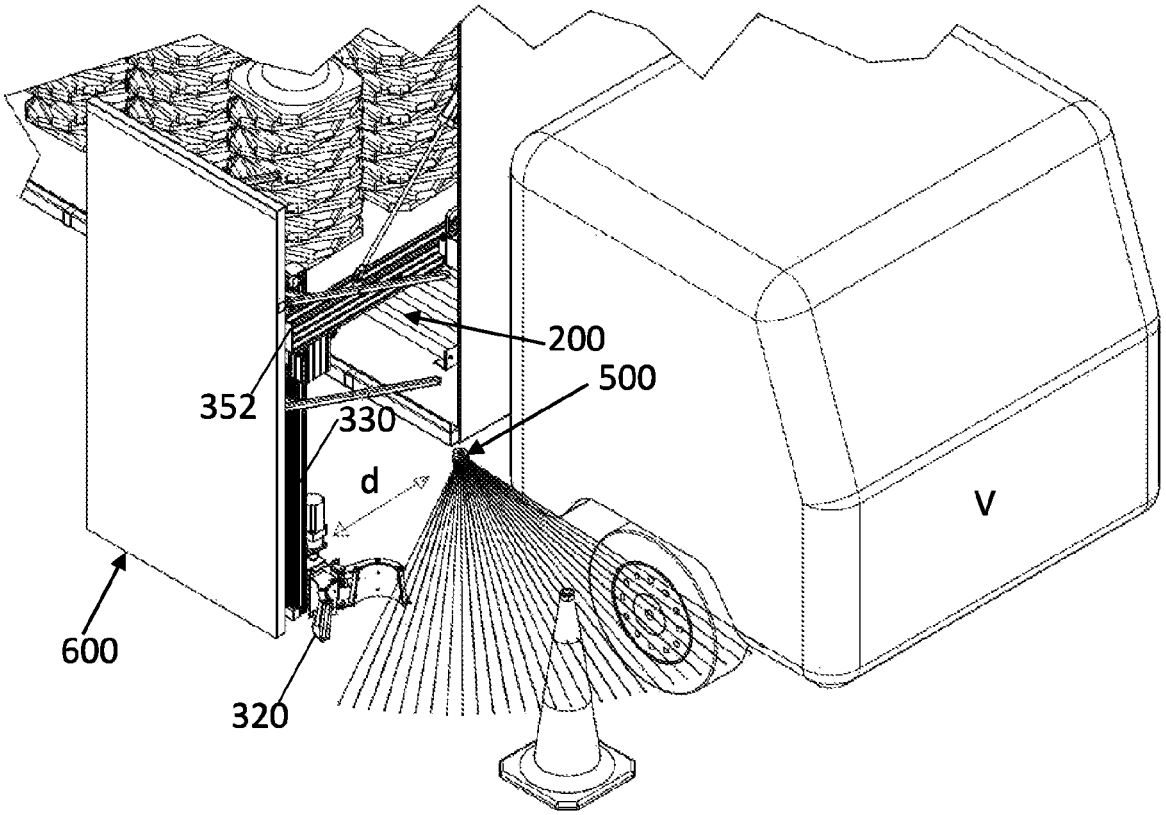
FIG. 17 is a frontal perspective view of a sensor assembly 500 that forms a part of the vehicle mounted system 1000 for sensing the location of a traffic cone positioned on the road beside the vehicle V.

A sensor assembly 500, as shown in FIG. 17 may also be provided for sensing location of a traffic cone positioned on the road and a controller (not shown) may be used for controlling the movement of the transverse gripper supporting rail 352 in response to the sensed location of the traffic cone. A LIDAR based measuring system 500 (as shown in FIG. 17) may be used for sensing the location of the traffic cone on the road. Specifically, the LIDAR sensor 500 may include a support structure (not shown) with a plurality of laser emitters supported by the support structure. A plurality of photodiode detectors may also be supported by the support structure (not shown) for emitting and detecting multiple pulses in rapid succession by sequentially varying the direction of the emissions such that each distance measurement is a pixel. A collection of pixels emitted and captured in rapid succession are then rendered by an on-board processor for sensing the location of the traffic barrier positioned on the road (effectively in a three-dimensional space). Once the location, specifically horizontal distance (d) of the traffic cone and the vehicle tray T has been determined, the movement of the movable gripper supporting rail 352 may be controlled to position the gripper supporting rail 352 at a suitable horizontal position. Thereafter, the gripper rail 330 may be lowered to engage the gripping jaws 320 with the traffic cone thereby allowing the second transfer assembly 300 to retrieve the cone and transfer the cone back to the conveyor 200 in a manner as has been previously described.

Figure 18:
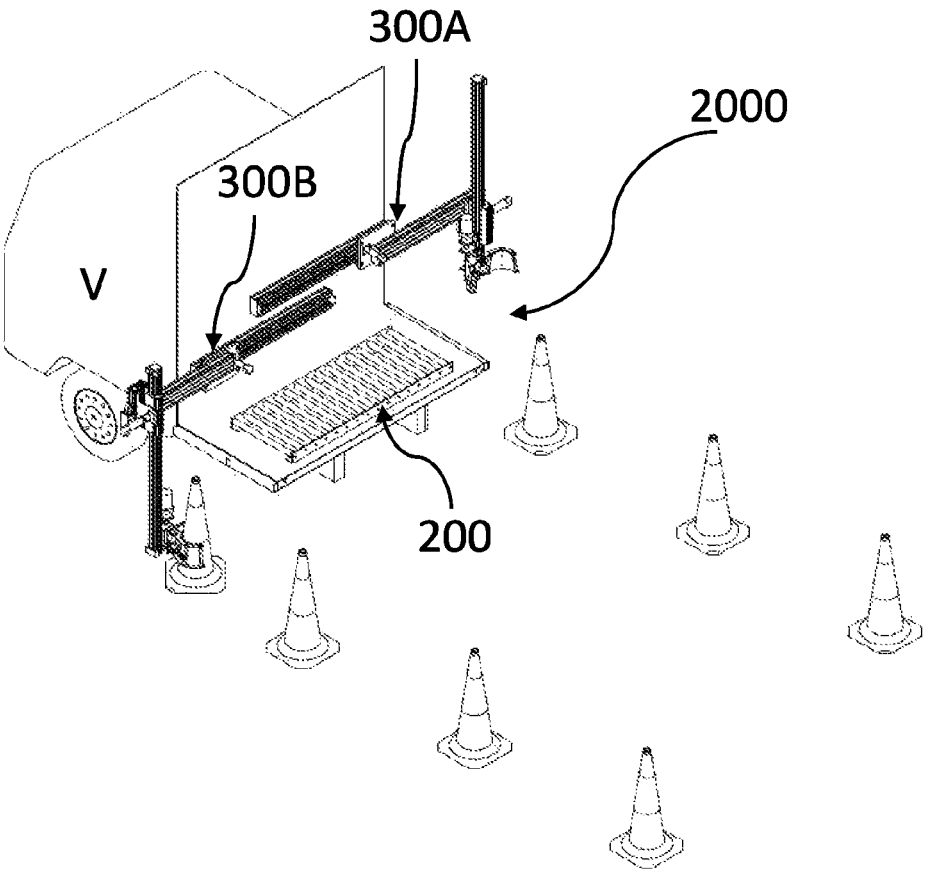
FIG. 18 is prospective view of a second embodiment of a vehicle mounted system 2000 comprising two of the second transfer assemblies, namely 300A and 300B for deployment and retrieval of cones from both lateral sides of a vehicle V.

Whilst the first embodiment depicted in FIGS. 1 to 17 refers to only one of the second transfer assemblies 300, multiple second transfer assemblies such as 300A and 300B as shown in another embodiment of the vehicle mounted system 2000 (shown in FIG. 18) may be provided to deploy traffic cones on both lateral sides of the tray T on the vehicle V shown in FIG. 18. Similarly, two of the second transfer assemblies 300A and 300B may also be used for retrieving traffic cones from either lateral side of the tray T.

Figure 19:
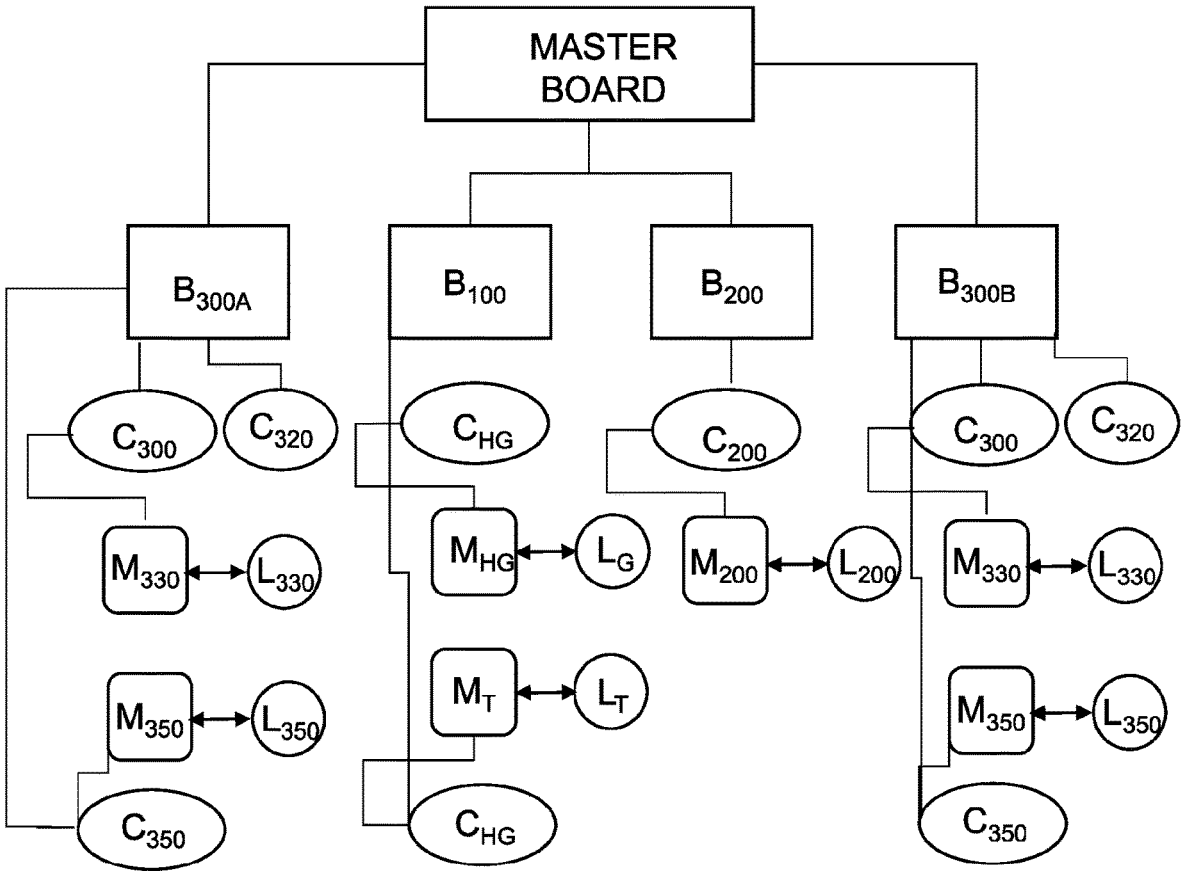
FIG. 19 is a block diagram for the electronic components of the vehicle mounted system 1000.

Referring to FIG. 19, a block diagram for the electronic components of the vehicle mounted system 1000 in which like references denote like features which have been previously described in the earlier sections. The motors $M_{HG}$ and $M_T$ and the associated controllers $C_{HG}$ and $C_T$ and limit switches ($L_G$ and $L_T$) are connected to gantry circuit board $B_{100}$. The motor $M_{200}$ and its controller $C_{200}$ and the associated limit switches $L_{200}$ that form part of the conveyor and platform assembly 200 are connected to separate circuit board $B_{200}$. The motors $M_{330}$ and $M_{350}$ and the associated controllers $C_{300}$ and $C_{350}$ and the limit switches $L_{300}$ and $L_{350}$ that form part of the second transfer assemblies 300A and 300B (generally denoted by 300 throughout the specification) are connected to respective retrieval circuit boards $B_{300A}$ and $B_{300B}$. Each of the circuit boards $B_{100}$, $B_{200}$, $B_{300A}$ and $B_{300B}$ may be connected to a master board as shown in FIG. 18 to effectively control and manage operation of the system 1000.

In compliance with the statute, the invention has been described in language more or less specific to structural or methodical features. The term "comprises" and its variations, such as "comprising" and "comprised of" is used throughout in an inclusive sense and not to the exclusion of any additional features.

It is to be understood that the invention is not limited to specific features shown or described since the means herein described comprises preferred forms of putting the invention into effect.

The invention is, therefore, claimed in any of its forms or modifications within the proper scope of the appended claims appropriately interpreted by those skilled in the art.

The invention claimed is:

1. A vehicle mountable system for deploying and retrieving traffic barriers to and from a plurality of locations on a road, the system comprising:

a gantry frame assembly with one or more horizontal frame members adapted to extend above a tray of a vehicle, a first transfer assembly movably coupled with the gantry frame for transferring one or more upright traffic barriers positioned on the vehicle tray between a storage location on the tray of the vehicle and an intermediate holding location on a platform assembly located below the one or more horizontal frame members of the gantry frame assembly, and a second transfer assembly for transfer of the one or more upright traffic barriers between the intermediate holding location on the platform and a deployment location on the road, wherein the first transfer assembly further comprises:

a powered hoist for lifting the one or more upright traffic barriers placed on the tray or lowering the one or more upright traffic barriers onto the tray, the powered hoist comprising:

a transverse support extending transversely relative to the horizontal members of the gantry frame assembly;

one or more upright rail members extending downwardly from the transverse support and coupled to the transverse support by a coupling arrangement to effect upward and downward movement of the transverse support; and, a first powered movement mechanism for effecting movement of the hoist along the length of the one or more horizontal frame members;

wherein the platform assembly comprises a conveyor for conveying the one or more upright traffic barriers positioned on the conveyor between the intermediate holding location and a pre-deployment holding location, wherein the pre-deployment holding location is located in close proximity to the second transfer assembly relative to the intermediate holding location.

2. A vehicle mounted system as claimed in claim 1 wherein the transverse support includes a grappling arrangement for grasping the one or more upright traffic barriers positioned in the storage location; and, the one or more upright rail members are coupled to the transverse support by the coupling arrangement to effect upward and downward movement of the transverse support and the grappling arrangement attached thereto.

3. A vehicle mounted system in accordance with claim 2 wherein the transverse support and/or the upright rail members are mounted on a motorised carriage adapted for travel along the length of the horizontal members of the gantry assembly.

4. A vehicle mounted system in accordance with claim 2 wherein the grappling arrangement comprises a plurality of grapplers for simultaneously grasping the one or more upright traffic barriers for lifting the one or more upright traffic barriers placed on the tray or the platform.

5. A vehicle mounted system in accordance with claim 4 wherein each grappler comprises a hollow enclosure with guiding surfaces to engage and receive the one or more upright traffic barriers therein and wherein the grappler further comprises a pneumatically actuated engagement for engaging a top portion of one of the one or more upright traffic barriers when the one of the one or more upright traffic barriers is being lifted or lowered by the hoist.

6. A vehicle mounted system in accordance with claim 5 wherein:

in a first operable configuration, the conveyor is configured to convey at least one of the one or more upright traffic barriers positioned on the conveyor from the intermediate holding location to the pre-deployment holding location to allow the second transfer assembly to then transfer the at least one of the one or more upright traffic barriers from the pre-deployment holding location to the deployment location; and in a second operable configuration, the conveyor is configured to convey the one or more upright traffic barriers positioned on the conveyor from the pre-deployment holding location to an intermediate holding location to allow the second transfer assembly to subsequently transfer another of the one or more upright traffic barriers from a deployment location to said pre-deployment location on the conveyor.

7. A vehicle mounted system in accordance with claim 1 wherein the second transfer assembly comprises:

one or more gripping members for gripping the one or more upright traffic barriers positioned at said intermediate location or the deployment location;

a powered lifting arrangement coupled to the one or more gripping members to effect upward and downward movement of the one or more gripping members relative to the platform and the road; and a second powered mechanism to effect movement of the one or more gripping members in a lateral direction relative to the direction of motion of the vehicle to allow either deployment of the one or more upright traffic barriers on the road or retrieval of the one or more upright traffic barriers from the road.

8. A vehicle mounted system in accordance with claim 7 wherein the one or more gripping members are mounted on a motorised gripper rail that is adapted for upward and downward movement relative to the platform assembly and the road.

9. A vehicle mounted system in accordance with claim 8 wherein the gripper rail of the second transfer assembly is movably mounted on a gripper rail mounting assembly for allowing motorised upward and downward movement of the gripper rail relative to the gripper rail mounting assembly.

10. A vehicle mounted system in accordance with claim 9 wherein the second powered mechanism effects movement of the gripper rail mounting assembly in a lateral direction relative to the direction of motion of the vehicle to allow either deployment of the one or more upright traffic barriers on the road or retrieval of the one or more upright traffic barriers from the road.

11. A vehicle mounted system in accordance with claim 9 wherein the gripper rail mounting assembly is fixedly mounted on a movable gripper supporting member that extends transversely relative to the gripper rail, the gripper supporting member being powered for movement in the lateral direction by the second powered mechanism.

12. A vehicle mounted system in accordance with claim 11 wherein the gripper supporting member is movably mounted relative to a fixed gripper supporting member extending across the length of the tray of the vehicle.

13. A vehicle mounted system in accordance with claim 7 further comprising a motorised turning mechanism to effect a turning movement of the one or more gripping members relative to a longitudinal axis of the gripper rail through an angle of 180 degrees or more.

14. A vehicle mounted system in accordance with claim 7 wherein the one or more gripping members comprise a fixed gripping jaw and a movable gripping jaw such that in a closed position, inner surfaces of the jaws cooperate to form a frusto-conical surface for engaging an outer surface of the one or more upright traffic barriers.

15. A vehicle mounted system in accordance with claim 7 further comprising:

a sensor assembly for sensing a location of the one or more upright traffic barriers positioned on the road.

* * * * *